United States Patent [19]

Miyama et al.

[11] 4,331,508

[45] May 25, 1982

[54] PHOTOGRAPHIC SUPPORT

[75] Inventors: Masao Miyama; You Kusama, both of Tokyo, Japan

[73] Assignee: Mitsubishi Paper Mills, Ltd., Tokyo, Japan

[21] Appl. No.: 280,351

[22] Filed: Jul. 6, 1981

Related U.S. Application Data

[63] Continuation-in-part of Ser. No. 111,297, Jan. 11, 1980, Pat. No. 4,288,287.

[30] Foreign Application Priority Data

Jan. 16, 1979 [JP] Japan ..... 54-3572
Jan. 20, 1979 [JP] Japan ..... 54-5690

[51] Int. Cl.[3] ..... D21H 1/34

[52] U.S. Cl. ..... 162/135; 162/146; 428/513; 430/536; 430/538

[58] Field of Search ..... 162/135, 158, 175, 178, 162/179, 146; 430/536, 538; 428/513

[56] References Cited

U.S. PATENT DOCUMENTS

| | | | |
|---|---|---|---|
| 3,096,231 | 7/1963 | Griggs et al. | 430/538 |
| 3,592,731 | 7/1971 | Griggs | 430/538 |
| 3,630,830 | 12/1971 | Herdle | 162/135 |
| 4,110,155 | 8/1978 | Minagawa et al. | 162/135 |
| 4,188,220 | 2/1980 | Kasugai et al. | 428/913 |

FOREIGN PATENT DOCUMENTS

| | | | |
|---|---|---|---|
| 693589 | 9/1964 | Canada | 162/146 |
| 45-14121 | 5/1970 | Japan | 162/146 |

*Primary Examiner*—William F. Smith
*Attorney, Agent, or Firm*—Cushman, Darby & Cushman

[57] ABSTRACT

A photographic support comprises a paper coated on both sides with polyethylene resin film. To impart the paper a desirable stiffness and improved cutting property, polyvinyl alcohol fibers which are neither heat-treated nor acetalized, in 5–20 parts by weight, are mixed to 100 parts by weight of woodpulp fibers when the paper is formed.

7 Claims, No Drawings

PHOTOGRAPHIC SUPPORT

CROSS-REFERENCE TO RELATED APPLICATION

This application is a continuation-in-part of Application Ser. No. 111,297 filed on Jan. 11, 1980, now U.S. Pat. No. 4,288,287.

BACKGROUND OF THE INVENTION

This invention relates to photographic paper supports and more particularly to photographic paper supports having polyethylene resin layers on both sides.

The photographic support rolls are coated with photographic emulsion to be made into photographic paper rolls, which is turn are printed, developed, and finally cut into sheets of a predetermined size. Said cutting step is automated and this automatic cutting step has to be facilitated by perforating a hole or putting a mark on the photographic paper surface at a preceding step so that exact cutting positions are established. Hitherto, because of poor cutting property of the supports at the perforating and cutting steps, there often occur such problems as irregular cut edges, generation of paper dusts, in an extreme case incomplete cutting or hanging of waste debris onto the cut paper sheet and in the worst case unseparation of the paper sheets. Furthermore, in the case of providing a hole of about 0.5–1 mm as a cutting mark, the hole is filled up with trailing or whiskering of fibers or polyethylene resins of the support thus cannot be detected by a photocell resulting in the incomplete cutting or miss cutting very often. One way to solve this trouble is to always maintain the cutting or the perforating knife sharp. In order to do so, sharpness of the knives have to be checked constantly and the knife blades be changed frequently. This knife maintenance is hard and cumbersome, necessitates frequent shutdowns for knife change, therefore lowers productivity and increases costs. Therefore, such photographic supports of improved cutting property that would assure longer span of the knife repairs have been much demanded.

Furthermore, a light weight photographic polyethylene coated paper has been desired for convenience of handling and for reduction of freights, postages and costs for woodpulps and other materials. However, there is a problem that the lighter the photographic support papers are made to, the less stiff they become.

It is necessary for obtaining photographic polyethylene coated papers having good cutting properties at the cutting and perforating steps to reduce long fiber furnish as far as possible. However, hitherto, production of light weight photographic support papers having stiffness as high as that of ordinary weight papers requires furnish of long and strong woodpulp fibers such as softwood bleached kraft pulp (NBKP) or softwood bleached sulfite pulp (NBSP).

Trailing or whiskering of fibers at cut edges of supports occurs more or less regardless of length of fibers contained in the supports, but there is a tendency that longer the fibers, the more it occurs. Especially, light weight resin coated papers having, for example, a basis weight of less than 160 g/m$^2$, especially less than 150 g/m$^2$ are required to have increased stiffness and for this purpose it is preferred to use long and strong fibers in a large amount. Thus, it is earnestly desired to reduce formation of trailing or whiskering of fibers at cut edges.

The inventors, as a result of intensive researches on the improvement of supports, have found photographic supports which have extremely improved cutting properties at perforating or cutting steps.

SUMMARY OF THE INVENTION

It is an object of this invention to provide photographic resin coated supports which have good cutting and perforating properties and develop no troubles when cut by automatic cutters.

It is another object of this invention to provide light weight photographic supports of less than 160 g/m$^2$, especially less than 150 g/m$^2$, which have good cutting and perforating property, i.e., to cause formation of little trailing or whiskering of fibers at cut edges and have sufficient stiffness.

According to this invention there is provided an improved photographic support which comprises a paper made from woodpulp fibers and containing a sizing agent and a strength reinforcing agent, and a polyethylene resin coated thereon, the bone dry weight ratio of said strength reinforcing agent to said sizing agent being 1.8–4.0 to 1 and the amount of the sizing agent being 0.3–1.0% by weight of the woodpulp fibers, wherein said polyethylene resin coated on the back side of the paper contains 35–80% by weight of low-density polyethylene, wherein the paper stock contains polyvinyl alcohol fibers in an amount of 5–20% of the oven-dry weight based on the woodpulp fibers, said polyvinyl alcohol fibers maintaining a fibrous shape and adhering to the woodpulp fibers and wherein the woodpulp fibers constituting the paper stock have fractionation characteristics in accordance with the fractionation method specified in JISP 8207 such that 5–40% is retained by the first wire sieve cloth having a sieve opening of 710 μm and more than 35% is retained by the second wire sieve cloth having a sieve opening of 350 μm.

DETAILED DESCRIPTION OF THE INVENTION

The strength reinforcing agent herein used means an interfiber bonding agent which has an action of reducing interfibers slipage upon cutting of photographic papers. Examples of the strength reinforcing agent are; polyacrylamide, starch, modified starch, polyvinyl alcohol, melamine-formaldehyde resin, urea-formaldehyde resin, polyamide-epichlorohydrin, gums, etc. which are generally used in the paper industry. Among them, polyacrylamide is especially preferred in this invention.

Generally, these strength reinforcing agents have been used in an amount of 0.5–1.6% by weight of woodpulp fibers and in an amount of up to 1.5 times that of sizing agent used in combination. In this invention, the amount of the former is increased to the range of 1.8–4 times that of the latter.

The sizing agents used in this invention are those ordinarily used and they include alkylketene dimers, rosin sizing agents, wax sizing agents, asphalt emulsion sizing agents, synthetic high polymer sizing agents, alkali metal salts of fatty acids of 14–20 total carbon atoms and combinations thereof. Alkylketene dimers and alkali metal salts of fatty acids of 14–20 carbon atoms are preferred. The fatty acids may be saturated or unsaturated fatty acids. The fatty acids having 14–20 total carbon atoms are, e.g., palmitic acid, stearic acid, oleic acid, etc. and those having 16–18 total carbon atoms are especially preferred. Among them, stearic acid salts, especially sodium stearate, are preferred.

The less the amount of the sizing agent is, the more the cutting property is improved, but on the other hand the higher a degree of edge stain that is caused by penetration of chemicals such as developing solution into polyethylene resin coated papers from their edges will result. Therefore, there is limitations within which addition of the sizing agent must be controlled. The amount of the sizing agent is at least 0.2%, preferably 0.3–1.0% by weight of woodpulp fibers.

Combination of an alkylketene dimer as the sizing agent with a polyacryl amide as the strength reinforcing agent or that of an alkali metal salt of fatty acid of 14–20, preferably 16–18 total carbon atoms, e.g., sodium stearate as the sizing agent with polyacrylamide as the strength reinforcing agent are especially effective.

Content of low-density polyethylene in polyethylene resin coated on the paper, especially on the side (hereinafter called back side) opposite to the side (hereinafter called emulsion side) on which emulsions are applied to preferably 35–80% by weight, more preferably 40–70% by weight. Polyethylene resin of such compositions can minimize the formation of trailing or whiskering of the resin at cut edges. Since the polyethylene layer on the emulsion side is coated with emulsions, formation of trailing or whiskering of polyethylene resin on this side is less than on the back side. Therefore, content of low-density polyethylene in the polyethylene layer on the emulsion side is not necessarily within the range mentioned above for decreasing formation of the trailing or whiskering of the resin at cut edges. The low-density polyethylenes herein used are those having a density of 0.910–0.925 and high-density polyethylenes are those having a density of at least 0.96. That is, it has been confirmed that when a polyethylene resin containing 35–80% by weight, preferably 40–70% by weight of low-density polyethylene, is coated on both sides or at least on the back side of the paper, formation of trailing or whiskering of polyethylene resin decreases.

The woodpulp used in this invention includes softwood bleached sulfite pulp (NBSP), hardwood bleached sulfite pulp (LBSP), softwood bleached kraft Pulp (NBKP), hardwood bleached craft pulp (LBKP), etc., but there is substantially no limitation regarding their kinds.

Formation of trailing or whiskering of pulp fibers can be reduced by adding to the woodpulp fibers polyvinyl alcohol fibers which are neither acetalized nor heat-treated, and the paper thus formed is in turn heat-treated at a temperature of at least 50° C. This method is especially effective for light weight photographic support papers having a basis weight of, for example, less than 160 g/m$^2$, further as light as 150 g/m$^2$, to have improved stiffness, since such light weight papers need to use long fibers in order to develop stiffness.

The polyvinyl alcohol fiber furnish in the paper is at least 5%, preferably 8–15% by oven-dry weight based on the woodpulp fibers. When the furnish is less than 5%, no substantial increase in stiffness is obtainable for the light weight photographic support. On the other hand, when the furnish is increased to more than 25%, the paper web being formed come to stick to a cylinder dryer.

When long woodpulp fiber furnish is increased in order to make up for decrease in stiffness of light weight papers, trailing or whiskering of the fibers at cut edges tends to become prevailing. Addition of the polyvinyl alcohol fibers is the right correction to impart stiffness of the light weight papers without aggraviating trailing or whiskering of the fibers at cut edges. Therefore according to this invention where polyvinyl alcohol fibers are contained as an essential component in the paper stock, the technical effects by addition of the polyvinyl alcohol fibers are observed especially when the woodpulp fibers constituting the paper stock have fractionation characteristics in accordance with the fractionation method specified in JISP 8207 such that 5–40% is retained by the first wire sieve cloth having a sieve opening of 710 μm and more than 35% is retained by the second wire sieve cloth having a sieve opening of 350 μm.

Polyvinyl alcohol fibers used in this invention are those not heat-treated after spinning (or those slightly heat-treated may be used), those not acetalized, and those cut to 1–6 mm. The fibers swell and disperse well in water at room temperature, are corruptible, therefore have good paper-making property. Fineness and length of the fibers are not critical as long as they can be practically used. Ordinarily, their fineness is 0.5–2 denier and length 1–6 mm.

Paper made from a furnish containing aforesaid polyvinyl alcohol fibers is usually heat-treated at 50°–100° C. as it is dried at dryer part of a paper machine. The polyvinyl alcohol fibers may melt during drying, but it is important that only surface portions of the polyvinyl alcohol fibers be melted to bond with woodpulp fibers. It is not preferred to raise the dryer temperature to higher than necessary. Preferred temperature conditions are such that fibrous shape of most of said polyvinyl alcohol fibers is reserved. Thus heat-treated paper is coated with polyethylene resin on both sides as mentioned before to obtain the photographic polyethylene coated paper.

As compared with a photographic support paper which is not furnished with the aforesaid polyvinyl alcohol fibers, the paper thus obtained has better cutting or perforating property, that is, produces little dust or does not cause such troubles as hanging of waste debris onto the cut sheet, and thus incomplete cutting can be prevented at cutting step. Also, the photographic support paper of this invention does not develop trailing or whiskering of fibers at edges of holes which are perforated by a cutting mark puncher so that the miscut troubles caused by unsuccessful detection of the cutting mark by a photocell can be avoided.

In addition, as compared with a paper which does not employ the aforesaid polyvinyl alcohol fibers, the photographic polyethylene coated papers of this invention have remarkably high stiffness. This is particularly advantageous for producing light weight papers.

The photographic supports of this invention have good cutting property at cutting and perforating steps as compared with conventional photographic supports.

The photographic supports of this invention, when turned into end uses, have clean-cut edges, generate little paper dusts, and cause no hanging of waste debris onto the paper sheet and no unseparation of sheets due to incomplete cutting. Therefore, sharpness of cutting or perforating knives becomes less critical, and intervals between the knife blade changes can be extremely extended. Furthermore, when the supports are perforated by a perforating apparatus for making cutting marks formation of trailing or whiskering of woodpulp fibers or polyethylene resin is conspicuously decreased, thus the trouble of miscutting or unseparation of sheet due to erroneous detection by a photocell can be avoided. Moreover, even an especially light weight polyethylene coated paper has a very high stiffness and is fully satisfactory in practice.

The following examples are intended to further illustrate the invention, but they are not intended to limit the scope thereof.

In these examples, the cutting property of supports when cut by a cutter is determined as follows: A photographic polyethylene coated paper roll on which emulsions are applied is printed and developed and in turn cut by Autocutter PKII manufactured by Copal K.K., Japan. Cleanness of cut edges, namely, degree of trailing or whiskering of fibers thereof is judged by naked eye and graded to 1 through 10, wherein the least whiskering or trailing is graded as 1 and the worst as 10. It was found that this cutting property testing results simulate successfully those with a commercially-run apparatus of making cutting marks.

Stiffness of photographic polyethylene coated papers is measured according to JISP 8143 and freeness of the woodpulp is measured by Canadian Freeness Tester according to JISP 8121.

EXAMPLE 1

A woodpulp slurry which consisted of 30 parts by weight of NBKP, 40 parts by weight of NBSP, and 30 parts by weight of LBKP was beaten so that 0% of the woodpulp fibers is retained by the first wire sieve cloth having sieve opening of 710 μm and 40% by the second wire sieve cloth having sieve opening of 350 μm. This fractionation test was in accordance with JISP8207. A paper was made from a furnish consisting of the beaten woodpulp, 1.05% and 2% by weight based on the pulp of alkylketene dimer (solid) as a sizing agent and STARGUM A-15 (solid) as a strength reinforcing agent which is manufactured by Seiko K.K. Japan and composed mainly of polyacrylamide, respectively, and 10% by weight based on the pulp of FIBRIBOND 341 (polyvinyl alcohol fiber which is neither heat-treated nor acetalized and is sold by Sansho K.K., Japan). The paper thus made was called paper 1. Similarly, 9 other papers 2–10 were prepared by using pulps having the fiber fractionation characteristics such that 5–45% are retained by the first wire sieve cloth having a sieve opening of 710 μm and 40% is retained by the second wire sieve cloth having a sieve opening of 350 μm.

The basis weight of each paper was 150 g/m$^2$. Both surfaces of these papers 1–10 were extrusion-coated with a polyethylene resin comprising 50 parts by weight of a low-density polyethylene (LDPE) having a density of 0.92 and 50 parts by weight of a high-density polyethylene (HDPE) having a density of 0.96 in a thickness of 30 μm. The thus obtained polyethylene coated papers were applied with a silver halide photographic emulsion and were subjected to automatic printing and developing treatments. These polyethylene coated papers made from papers 1–10 were called samples 1–10, respectively. Grades of whiskering or trailing of fibers at cut edges and stiffness are shown in Table 1.

TABLE 1

| Sample No. | Fractionation characteristic: Retained by the first wire sieve cloth (%) | Fractionation characteristic: Retained by the second wire sieve cloth (%) | Grade of trailing or whiskering of fibers at cut edges | Stiffness (cm$^3$/100) | Remarks |
|---|---|---|---|---|---|
| 1 | 0 | 40 | 1 | 191 | Comparative Example |
| 2 | 5 | " | 1 | 200 | Example |
| 3 | 10 | " | 1 | 205 | Example |
| 4 | 15 | " | 1 | 210 | Example |
| 5 | 20 | " | 1 | 213 | Example |
| 6 | 25 | " | 1 | 215 | Example |
| 7 | 30 | " | 1 | 217 | Example |
| 8 | 35 | " | 1.5 | 219 | Example |
| 9 | 40 | " | 1.5 | 220 | Example |
| 10 | 45 | " | 2 | " | Comparative Example |

EXAMPLE 2

Samples 11–15 were prepared in the same manner as in Example 1 except that there were used pulps having the fiber fractionation characteristics such that 5% is retained by the first wire sieve cloth having a sieve opening of 710 μm and 30–65% are retained by the second wire sieve cloth having a sieve opening of 350 μm. Grades of whiskering or trailing of fibers at cut edges and stiffness are shown in Table 2.

TABLE 2

| Sample No. | Fractionation characteristic: Retained by the first wire sieve cloth (%) | Fractionation characteristic: Retained by the second wire sieve cloth (%) | Grade of trailing or whiskering of fibers at cut edges | Stiffness (cm$^3$/100) | Remarks |
|---|---|---|---|---|---|
| 11 | 5 | 30 | 1 | 196 | Comparative Example |
| 12 | " | 35 | 1 | 198 | Example |
| 2 | " | 40 | 1 | 200 | Example |
| 13 | " | 45 | 1 | 202 | Example |
| 14 | " | 55 | 1 | 203 | Example |
| 15 | " | 65 | 1 | " | Example |

EXAMPLE 3

Samples 16–20 were prepared in the same manner as in Example 1 except that there were used pulps having the fiber fractionation characteristics such that 15% is retained by the first wire sieve cloth having a sieve opening of 710 μm and 30–65% are retained by the second wire sieve cloth having a sieve opening of 350 μm. Grades of whiskering or trailing of fibers at cut edges and stiffness are shown in Table 3.

TABLE 3

| Sample No. | Fractionation characteristic: Retained by the first wire sieve cloth (%) | Fractionation characteristic: Retained by the second wire sieve cloth (%) | Grade of trailing or whiskering of fibers at cut edges | Stiffness ($cm^3/100$) | Remarks |
|---|---|---|---|---|---|
| 16 | 15 | 30 | 1 | 206 | Comparative Example |
| 17 | " | 35 | 1 | 208 | Example |
| 4 | " | 40 | 1 | 210 | Example |
| 18 | " | 45 | 1 | 212 | Example |
| 19 | " | 55 | 1 | 213 | Example |
| 20 | " | 65 | 1 | " | Example |

EXAMPLE 4

Samples 21–25 were prepared in the same manner as in Example 1 except that there were used pulps having the fiber fractionation characteristics such that 35% is retained by the first wire sieve cloth having a sieve opening of 710 μm and 30–65% are retained by the second wire sieve cloth having a sieve opening of 350 μm. Grades of whiskering or trailing and stiffness are shown in Table 4.

TABLE 4

| Sample No. | Fractionation characteristic: Retained by the first wire sieve cloth (%) | Fractionation characteristic: Retained by the second wire sieve cloth (%) | Grade of trailing or whiskering of fibers at cut edges | Stiffness ($cm^3/100$) | Remarks |
|---|---|---|---|---|---|
| 21 | 35 | 30 | 1.5 | 218 | Comparative Example |
| 22 | " | 35 | " | 219 | Example |
| 8 | " | 40 | " | " | Example |
| 23 | " | 45 | " | " | Example |
| 24 | " | 55 | " | " | Example |
| 25 | " | 65 | " | 220 | Example |

EXAMPLE 5

Samples 26–32 were prepared by changing the amount of polyvinyl alcohol fiber (FIBRIBOND 341) which was added to the woodpulp. Other conditions for preparing these samples were constant. Main conditions are summarized as follows.

(1) The woodpulps having the following fiber fractionation characteristics were used.

| Retention of fibers: by the 1st wire sieve cloth | Retention of fibers: by the 2nd wire sieve cloth |
|---|---|
| 15% | 40% |

(2) Sizing agent (alkylketene dimer): 1.05% by weight based on the pulp
Strength reinforcing agent (STARGUM A-15): 2% by weight based on the pulp
Strength reinforcing angent/sizing agent = 1.9

(3) Content of LDPE in the polyethylene resin
Back side: 50% by weight
Emulsion side: 50% by weight Grades of whiskering or trailing and stiffness are shown in Table 5.

TABLE 5

| Sample No. | PVA fiber (% based on the pulp) | Grade of trailing or whiskering at cut edges | Stiffness ($cm^3/100$) | Remarks |
|---|---|---|---|---|
| 26 | 0 | 7.0 | 185 | Comparative Example |
| 27 | 3 | 5.0 | 188 | Comparative Example |
| 28 | 5 | 3.5 | 195 | Example |
| 29 | 8 | 1.5 | 207 | Example |
| 4 | 10 | 1 | 210 | Example |
| 30 | 15 | 1 | 216 | Example |
| 31 | 20 | 1 | 221 | Example |
| 32 | 25 | 1 | 223 | Comparative Example Remarkable filthiness of dryer drum and canvas |

EXAMPLE 6

Samples 33–45 were prepared by changing the content of low density polyethylene (LDPE) in the polyethylene resin coated on the back side and the emulsion side of the paper. Other conditions for preparing these samples were constant. Main conditions are summarized as follows.

(1) The woodpulps having the following fiber fractionaction characteristics were used.

| Retention of fibers | |
|---|---|
| by the 1st wire sieve cloth | by the 2nd wire sieve cloth |
| 15% | 40% |

(2) Sizing agent (alkylketene dimer): 1.05% by weight based on the pulp
Strength reinforcing agent (STARGUM A-15): 2% by weight based on the pulp
Strength reinforcing agent/sizing agent = 1.9

(3) Polyvinyl alcohol fiber (FIBRIBOND 341): 10% by weight based on the pulp

Grades of whiskering or trailing and stiffness are shown in Table 6.

TABLE 6

| Sample No. | Content of LDPE in the resin layer (% by weight) Back side | Emulsion side | Grade of trailing or whiskering at cut edges | Stiffness ($cm^3/100$) | Remarks |
|---|---|---|---|---|---|
| 33 | 30 | 50 | 3 | 212 | Comparative Example |
| 34 | 35 | " | 2 | 211 | Example |
| 35 | 40 | " | 1 | " | Example |
| 4 | 50 | " | 1 | 210 | Example |
| 36 | 65 | " | 1 | 209 | Example |
| 37 | 70 | " | 1 | " | Example |
| 38 | 75 | " | 2 | 208 | Example |
| 39 | 80 | " | 2 | " | Example |
| 40 | 85 | " | 3 | " | Comparative Example |
| 41 | 100 | " | 3.5 | 207 | Comparative Example |
| 42 | 50 | 30 | 1.5 | 212 | Example |
| 43 | " | 40 | 1 | 211 | Example |
| 44 | " | 70 | 1 | 209 | Example |
| 45 | " | 80 | 1.5 | 208 | Example |

What is claimed is:

1. A photographic support which comprises a paper made from woodpulp fibers and containing a sizing agent and a strength reinforcing agent, and a polyethylene resin coated thereon, the bone dry weight ratio of said strength reinforcing agent to said sizing agent being 1.8–4.0 to 1 and the amount of the sizing agent being 0.3–1.0% by weight of the woodpulp fibers, wherein said polyethylene resin coated on the back side of the paper contains 35–80% by weight of low-density polyethylene, wherein the paper stock contains polyvinyl alcohol fibers in an amount of 5–20% of the oven-dry weight based on the woodpulp fibers, said polyvinyl alcohol fibers maintaining a fibrous shape and adhering to the woodpulp fibers and wherein the woodpulp fibers constituting the paper stock have fractionation characteristics in accordance with the fractionation method specified in JISP8207 such that 5–40% is retained by the first wire sieve cloth having a sieve opening of 710 μm and more than 35% is retained by the second wire sieve cloth having a sieve opening of 350 μm.

2. A photographic support according to claim 1 wherein the paper stock contains polyvinyl alcohol fibers in an amount of 8–15% of the oven-dry weight based on the woodpulp fibers.

3. A photographic support according to claim 1 wherein the woodpulp fibers constituting the paper stock have fractionation characteristics in accordance with the fractionation method specified in JISP8207 such that 15–30% is retained by the first wire sieve opening of 710 μm.

4. A photographic support according to claim 3, wherein woodpulp fibers constituting the paper stock have fractionation characteristics in accordance with the fractionation method specified in JISP8207 such that 15% is retained by the first wire sieve cloth having a sieve opening of 710 μm and 40% is retained by the second wire sieve cloth having a sieve opening of 350 μm.

5. A photographic support according to claim 1, wherein said polyethylene resin coated on the back side of the paper contains 40–70% by weight of low-density polyethylene.

6. A photographic support according to claim 1 wherein the polyethylene resin coated on the emulsion side of the paper contains 40–70% by weight of low-density polyethylene.

7. A photographic support according to claim 1 wherein the basis weight of the paper is not more than 160 $g/m^2$.

* * * * *